US005597032A

United States Patent [19]

Merrien

[11] Patent Number: 5,597,032

[45] Date of Patent: Jan. 28, 1997

[54] CONTROLLED METHOD FOR INJECTION CASING USING A MOLD UNDER VACUUM, ESPECIALLY INTENDED FOR ALUMINIUM OR MAGNESIUM ALLOYS AND DEVICE FOR CARRYING OUT SAID METHOD

[76] Inventor: Pierre Merrien, 29 Rue des Chênes, 64140 Billere, France

[21] Appl. No.: 617,959

[22] Filed: Mar. 11, 1996

Related U.S. Application Data

[63] Continuation of Ser. No. 239,974, May 9, 1994, abandoned.

[30] Foreign Application Priority Data

May 10, 1993 [FR] France ..... 93 05580

[51] Int. Cl.[6] ..... B22D 17/32

[52] U.S. Cl. ..... 164/457; 164/63; 164/255; 164/155.2

[58] Field of Search ..... 164/119, 306, 164/63, 254, 255, 457, 151.3, 155.2

[56] References Cited

U.S. PATENT DOCUMENTS

| | | | |
|---|---|---|---|
| 4,585,050 | 4/1986 | Merrien et al. | 164/457 |
| 4,714,102 | 12/1987 | Koya . | |

FOREIGN PATENT DOCUMENTS

| | | | |
|---|---|---|---|
| 0296074 | 6/1988 | European Pat. Off. . | |
| 59-54458 | 3/1984 | Japan | 164/63 |
| 61-95760 | 5/1986 | Japan . | |
| 61-245955 | 11/1986 | Japan | 164/457 |
| 2-70368 | 3/1990 | Japan | 164/457 |
| 2-127958 | 5/1990 | Japan | 164/63 |
| 2204816 | 11/1988 | United Kingdom . | |
| WO91/01833 | 2/1991 | WIPO | 164/457 |

*Primary Examiner*—Kuang Y. Lin
*Attorney, Agent, or Firm*—Bacon & Thomas

[57] ABSTRACT

A device for injection casting includes a furnace within which is position a crucible, a bell mounted atop a table into which a mold is positioned and a tube interconnecting the crucible and the mold. A device is provided to sense the level of metal within the crucible; piping is provided into the bell and the furnace for controlling the respective pressures therein and various sensors are provided in the bell, mold, tube and furnace which sense various pressures and temperatures experienced within the device during the casting operation. These sensors provide signals to a control apparatus which controls the pressure inside the furnace in order to fill the mold with metal inside the crucible and regulates the speed and pressure inside the mold. A method of operating the device is also provided.

20 Claims, 6 Drawing Sheets

CONTROLLED METHOD FOR INJECTION CASING USING A MOLD UNDER VACUUM, ESPECIALLY INTENDED FOR ALUMINIUM OR MAGNESIUM ALLOYS AND DEVICE FOR CARRYING OUT SAID METHOD

This application is a Continuation of application Ser. No. 08/239,974, filed May 9, 1994 now abandoned.

BACKGROUND OF THE INVENTION

The present invention relates to a new injection casting method using a mold which is kept under low pressure during filling, which method is more particularly intended for making:

- cast pieces in aluminum, copper, iron, chromium or nickel alloys,
- cast pieces in plastic materials,
- cast pieces having parts in fibers treated by impregnation, such parts generally including thin portions.

The conventional low pressure casting method has been known now since the beginning of the century: the metal is contained in a tight furnace, the mold is in contact with the metal via a tube. If the pressure is raised inside the furnace, the metal rises in the mold. After solidification, the pressure inside the furnace is reduced and the metal of the part which has not yet solidified is collected in the crucible.

The aim of the prior art has been essentially to bring two major improvements to the original method:

1) controlling the flow of metal, and
2) filling a mold under vacuum with a metal under pressure.

The control of the flow of metal is achieved by giving, in every point of the mold, to the advancing metal, a flowing speed which is high enough to prevent the advancing metal from solidifying before filling of the mold cavity is completed, and which is lower than the speed at which turbulences appear, which turbulences would cause the formation of oxides and gas pockets.

Therefore, at each point of the mold, the metal should have an optimum speed ranging between the two speeds discussed above; such speed is dependent on the geometry of the piece in that point, particularly on the thickness, on the nature of the mold (metallic, sand, ceramics), on the temperature of the metal and of the mold, on the nature of the metal, etc. . . .

The novelties which have resulted from the search for a solution represent three stages:

First stage: 1960/1975:

In French Patent No. 1 376 884, the pressure inside the furnace is controlled to reach values which are predetermined as a function of time. But since the height of the metal inside the crucible reduces as the casting operations follow one another, the predetermined value for a given time gives a different position inside the mold during a succession of castings. Moreover, no allowance is made for any adjustment caused by the temperature of the metal which affects its viscosity hence its flowing speed.

In French Patent No. 1 257 708, the method involves the use of a control device in order to obtain a constant pressure-increasing speed inside the furnace during filling of the mold cavity. Therefore there is no speed variation occurring during the casting as a function of the geometry of the different zones traversed by the metal. And moreover, just as before, there is no adjustment of the speed caused by the temperature.

French Patent No. 2 276 125 uses a low pressure casting installation associated with a calculator which ensures a pressure increase speed which is specific to each piece but constant up to the solidification threshold, the pressure of such solidification threshold being increased at each casting operation so as to take into account the weight of the metal used in the previous casting operation. Therefore, in this method, just as in the preceding ones, the flowing speed is not controlled as a function of the geometry of the part in its different zones. Also to be noted is the absence of adjustment due to temperature.

Second stage: 1972/1975:

French Patent No. 2 189 150 approaches the problem differently by allowing the flow over sensors, thus creating air flows of different values in order to vary the flowing speed of the metal, but such a control is affected by gas leaks which generally exist in industrial furnaces where tightness cannot be total. Therefore, predetermined speeds cannot be established by controlling air flows.

Third stage: 1979/1981:

To solve this problem of obtaining a predetermined flowing speed of the bead of metal in a given area, the Applicants have described in French Patent No. 7 917 317 and in European Patent No. 55947, the use of a reference sensor provided inside the stream of metal and detecting the passage of the metal. The pressure inside the furnace and the time taken by the metal to flow over the sensor are taken as being zero value in subsequent evolutions of the pressure inside the furnace. This makes it possible to overcome the effect of the height of the metal inside the crucible at the start of the cycle, a pressure zero and a time zero being always obtained at the same point, i.e. at the reference sensor.

This method, however, does not allow for three important factors, which are:

1) That the pressure can increase inside the mold during filling thereof due to the gases produced from the burning of the resins, porosity deficiencies in the sand, and the molds cast in low pressure conditions which are generally closed. But an open mold technique does exist.

The back pressure created by the gases reduces to the same value the pressure which causes the movement of the metal thereby reducing the speed thereof. This phenomenon occurs at random and the speed of the metal must therefore be controlled by the difference of pressure between the furnace and the mold, and not by the pressure of the furnace alone.

2) During the casting operation, the height of the metal in the crucible reduces and part of the pressure increase in the furnace is used for balancing said loss of height.

The predetermined speed to be obtained in a given point should therefore allow for such variation which may be very high for large pieces, even reaching up to one meter, i.e. being equivalent to the pressure used for filling the piece.

3) The reference sensor detecting the passage of the metal, described in Applicants' aforesaid patents is a dynamic detection sensor whose inertia, although low, causes the position of the point of the mold where the predetermined metal speed should be obtained, to shift.

It is the object of the present invention to provide a solution to said three problems relating to the control of the flow of metal:

- by controlling the speed of the metal flow from the pressure difference between furnace and mold,
- by allowing for the reducing height of the metal during the casting operation,
- by replacing the dynamic sensor by a static detection sensor which accurately defines the point of origin of the pressure variation inside the furnace right from the start of the cycle.

Different solutions have been proposed to the second problem arising in the original low pressure casting method, i.e. that of filling a mold under vacuum with a metal under pressure, essentially by:

Patent EP-2 0296 074, in which the two enclosures, one containing the metal and the other the mold, are placed under identical low pressures, an excess of pressure $\Delta p$ being then created in the enclosure containing the metal to enable the latter to fill the mold, and being kept constant until the end of the solidification step.

Patent FR-A-2 556 996, in which the mold and the enclosure containing the metal are, at the beginning, under the same low pressure, or at the atmospheric pressure. By creating a difference of pressure between the two enclosures, the metal is brought to the opening of the mold. From that point, the accuracy of which depends on the height of the metal inside the furnace, when there is no sensor, an excess pressure, with respect to the mold enclosure, is applied in the furnace, in order to fill the mold. Such excess pressure is obtained by introducing gases into the furnace through a pipe under a set pressure, and without any control.

U.S. Pat. No. 2,997,756 and U.S. Pat. 1,703,739 describe the filling of a metallic mold to obtain an ingot, the mold being placed inside an enclosure in which the pressure is raised.

Japanese Patent Abstract No. 61 095 760, in which the metal and the mold are located in two enclosures under reduced pressure. Filling is achieved by increasing the pressure in the enclosure containing the metal.

U.S. Pat. No. 5,042,561, in which the mold, which is under airless atmosphere and carries its injection tube, is placed on the furnace which is also under airless atmosphere. Both mold and furnace are, at the beginning, under atmospheric pressure.

An extra vacuum is created in the mold cavity in order to allow the metal to rise, which extra vacuum is kept up during solidification.

According to all the aforesaid methods, the metal fills up the mold at any speeds: a constant pressure is applied on the metal, or an extra vacuum is created in the mold cavity.

The object of the present invention is twofold. It is:

a) to ensure filling of the mold that is kept under low pressure or under vacuum, while observing predetermined speed values at every point of the mold, in order to create at said points conditions which will make it possible to obtain optimum metallurgic characteristics and to reproduce these characteristics from only one sensor located outside the mold and the metal stream. The sensor sends to the control apparatus signals indicating the position of the metal in the crucible at the start of the cycle, and during the cycle, in order to allow said apparatus to effect the necessary adjustments;

b) to ensure a solidification under pressure in order to prevent any release of the occluded gases which could occur during a solidification under a vacuum, even if only a partial vacuum. Such passage of the metal from a state under vacuum to a state under pressure is achieved, according to the present invention, according to a predetermined variation rate to arrive at the required level of pressure.

These objects are reached with the following steps:

1) the mold enclosure and the crucible enclosure which, at the beginning, are under atmospheric pressure, are then brought to the same predetermined low pressure level, 2) a metal level sensor measures the level and sends the information to the control apparatus, 3) then a gas, adapted to the metal to be cast (such as air or nitrogen for aluminum alloys, and CO2+SF6, Argon+SF6 for magnesium alloys) is injected into the crucible enclosure, while the mold enclosure is kept to the vacuum level of the first step or to a level near thereof, which level changes as the gas releases in the mold due to the combustion of the resins from the sand.

A control apparatus receives at any moment the information supplied by the sensors, which latter provide said apparatus with:

* on the one hand, the $\Delta P$ between the pressure inside the mold and the pressure inside the crucible enclosure,

* on the other hand, the difference between the quantity of metal contained in the crucible at the start of the cycle and the quantity present at the considered moment. Such reduction of the quantity of metal in the crucible may be determined, for example, by measuring the $\Delta H$ of height of the free surface of the liquid metal between the considered moments or the difference of mass.

Moreover, a quick response temperature sensor is provided at the opening of the mold and gives the temperature of the flowing metal, hence the $\Delta T$ between the real temperature of the metal and the reference temperature set for the cast pieces as parameters. According to the control apparatus, the $\Delta P$ corrected by the $\Delta H$ and the $\Delta T$, takes on predetermined values to obtain the optimum fill speed in accordance with the invention.

4) When filling of the mold is completed, an extra pressure is applied on the metal according to a predetermined variation in order to ensure the "feeding" of the piece which is going to solidify, i.e. the rising of the liquid metal from the crucible and the casting system up to those areas which are going to contract during solidification.

5) Having determined said extra-pressure, the mold enclosure is rapidly brought to a pressure which is higher than or equal to the atmospheric pressure, and the crucible enclosure is brought to a predetermined pressure higher than that of the mold enclosure. This stage will be maintained up to the end of the solidification of the piece.

Such pressures in the two enclosures, during solidification of the piece, may be:

of a low level (O to 1 bar, hence the designation of low pressure) for conventional castings, or of a high level (several tens of bars) for special cases such as for pieces comprising elements in composite materials with metallic matrix.

6) At the end of solidification, the two enclosures are depressurized and returned to the atmospheric pressure with predetermined speeds in order to prevent turbulences in the crucible when the metal flows back.

The crucible enclosure may also be kept under a residual pressure in order to keep the metal in the upper part of the tube.

During the variations of pressure after filling of the mold, it is the $\Delta P$ between the crucible enclosure and the mold enclosure which is used as a basis for controlling the pressure inside the furnace by the control apparatus, since the pressure sensor has become inoperative after the filling operation.

The following special cases should be noted:

A zero vacuum level corresponds to the conventional low pressure casting with the mold and the metal being at the atmospheric pressure at the start of the injection. The method then specially controls the flowing speed of the metal and of the extra pressure with adjustment due to the height of the metal inside the crucible and to the temperature at the entrance into the mold.

A level of vacuum above 500 millibars is used for magnesium alloys, which level can vary as a function of the nature of the alloy.

At the end of the mold-filling operation, it is possible not to have to apply extra pressures, to have feeder heads open at the top, and to achieve solidification under gravity of the upper part of the piece and solidification under pressure of the lower part.

The method, in this case, provides the control of the speed during filling, and the keeping of the metal at the higher level during solidification.

BRIEF DESCRIPTION OF THE DRAWINGS

The invention will be more readily understood on reading the following description of one embodiment of the method according to the invention, given by way of example and non-restrictively with reference to the accompanying drawings, in which.

DETAILED DESCRIPTION OF THE PREFERRED EMBODIMENT

Figure 1:
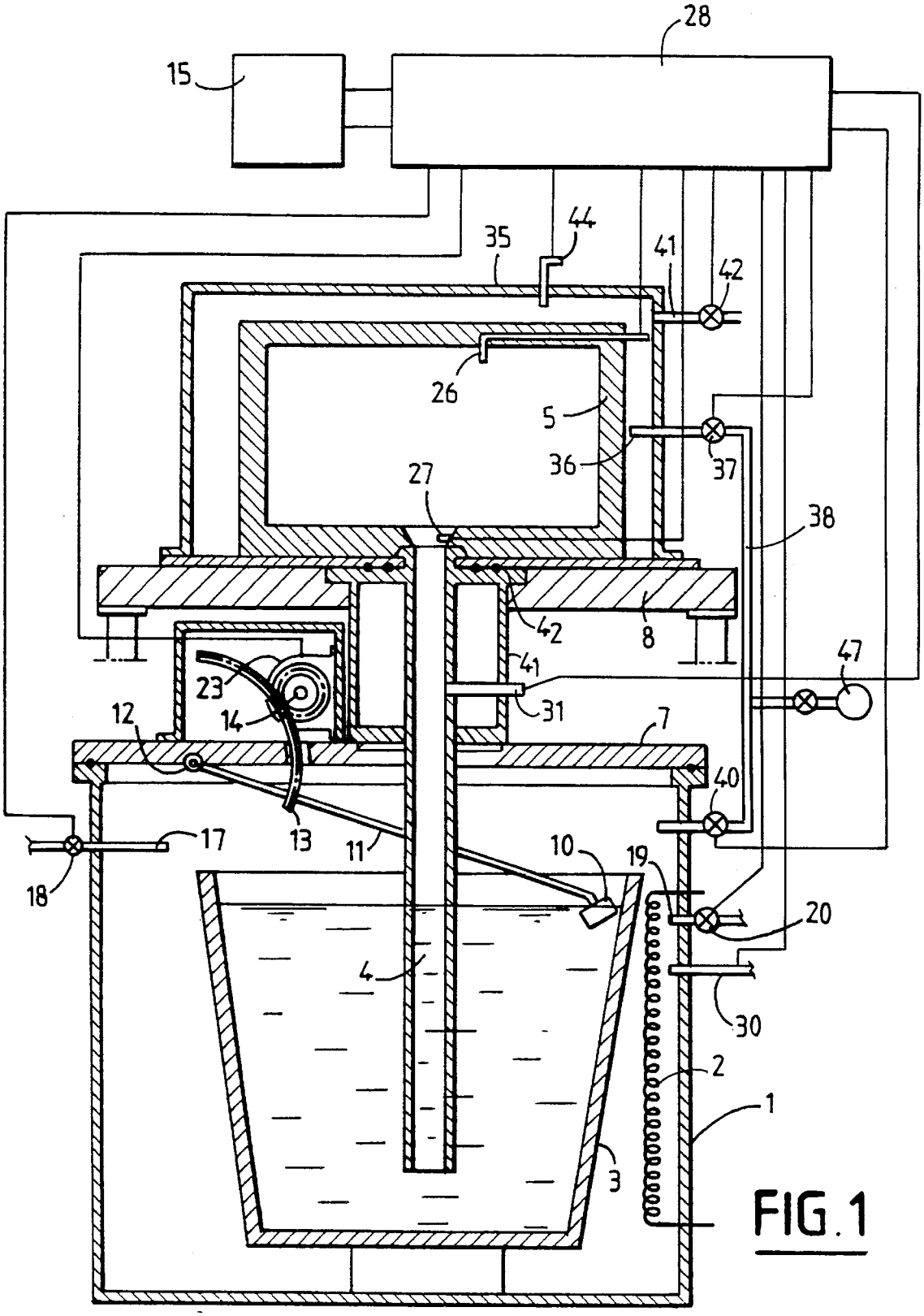
FIG. 1 is a diagram of an installation for carrying out the method with aluminum alloys and with vacuum and pressure.

In the installation illustrated in FIG. 1, the tight furnace 1 is heated by heating elements 2 which are unprotected since they work in the presence of air when aluminum is used. The metal is contained in the crucible 3.

A tube 4 connects the crucible 3 to the mold 5. Said tube is provided at its upper part with a controlled and electrically heated assembly $4_1$ forming one piece with the tube. Said upper part, which constitutes a nozzle, is, in the conventional technique of low pressure casting, separated from the tube for reasons of dismountability. But in applications where the mold 5 is placed under vacuum, the bearing surface between the nozzle and the tube should include O-rings to ensure tightness or the nozzle can be integrally formed as part of the tube as shown in FIG. 1. Such O-rings are produced in polymer and, being destroyable at 250° C., they have to be cooled by air-circulation chambers provided in the support flanges of the nozzle and the tube. Any tightness defect arising at that level causes air to enter the metal flowing in the tube, hence in the piece being produced by filling of the mold.

Such air pockets form bubbles which are at atmospheric pressure at 20° C., and which penetrate into the metal stream at 750° C. and under a few millibars (3 to 10 mb). Their volume is thus multiplied by a factor of 1000. Said bubbles split and disperse into the piece in the form of a fine mist which, after solidification of the metal, is going to render the structure of the piece extremely brittle. It is therefore important to eliminate them.

The polymer seals $4_2$ provided at the upper part of the nozzle are cooled by the plate supporting the mold, the temperature of which is between 20° and 40° C., such cooling ensuring adequate functioning thereof.

The one-piece assembly of the tube and nozzle is electrically heated and controlled. Said assembly is placed on the movable plate 7 and is applied under the casting plate 8 by vertical thrust of the furnace which is mounted on a jack. The mold 5 is placed on the casting plate 8.

Inside the furnace, the means provided for continuously determining the quantity of metal contained in the crucible comprise a height-measuring sensor constituted by a float 10 provided on the end of a lever 11 pivotally mounted at 12. The sector 13 is fast with the lever 11 and drives a toothed wheel 14 which in turn drives an angle-measuring sensor of conventional type, such as for example a rotary potentiometer. The toothed wheel 14 is likewise fast with the motor 23 so wheel 14 can be arranged in a predetermined position for reference purposes. The float 10 is preferably made of graphite so as to be able to resist dissolution by liquid aluminum and to be of lower density. The other elements of the device are preferably formed from refractory steel, resistant to corrosion at high temperature from corroding gases such as used in the case of magnesium. The metal height sensor supplies its information to the control apparatus 15.

The furnace comprises a gas injection pipe 17 with its controlled by electrovalve 18 having a proportional opening controlled by the control apparatus 15 and a decompression pipe 19 with its controlled electrovalve 20 which is, for example, of the on-off type. Indeed, the pressurizing proportional valve 18 brings to the metal a controlled rising speed, contrary to an on-off valve which gives small stopping stages in the case of low speeds, less than 3 to 4 cm per second. On the other hand, under decompression, the piece is solid and the on-off valve is without problem.

Pressure sensors are placed in the mold 5 at 26, inside the bell 35 at 44, inside the furnace 1 at 30 and at the mold entrance, there is provided a metal temperature sensor, such as a quick response thermocouple 27. The bell 35 is placed under vacuum via pipes 36 and 38, along with electrovalve 37; the furnace 1 is placed under vacuum via the tube 40 equipped with an electrovalve. The two pipes coming from the furnace and the bell are connected to the vacuum pump 47. The bell 35 carries a tube 41 equipped with an electrovalve 42, for placing said bell at the atmospheric pressure. All information delivered by the sensors are sent to the panel 28 which also contains programmable controllers for directing other actions than those of the casting cycle (movements of the furnace, of the mold, . . . ).

Figure 10:
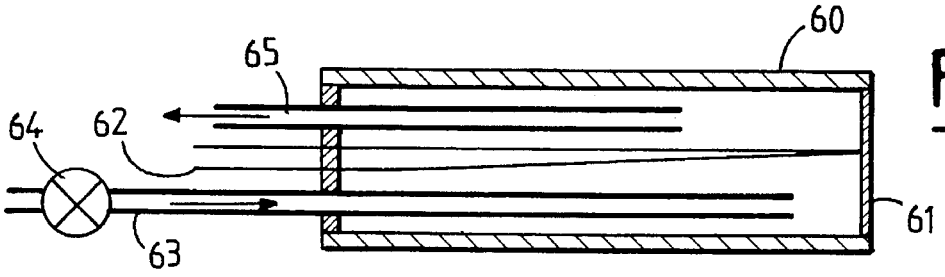
FIG. 10 is a cross-sectional view of the presence sensor.

Moreover, a presence sensor is provided in the nozzle for detecting the metal flowing past it. Said sensor is composed, according to FIG. 10, of a tube 60 made of refractory steel, at the end of which tube is provided a chip 61 on which is welded a thermocouple 62. Compressed air flows inside of tube 60 through air intake 63 and electrovalve 64 and out opening 65. Electrovalve 64 has a proportional opening. Electrovalve 64 is controlled by control apparatus 15 so as to obtain on the chip 61 before the casting cycle starts, a temperature within a given interval of time, which is necessary to obtain a satisfactory detection of the thermal shock. The air flow which cools the chip 61 enables the thermocouple to be protected against being dissolved by the liquid aluminum and enables the thermal shock to be registered when the metal flows over it. Such treatment is applied by the software of the control apparatus 15 which receives the information from the sensor. The control apparatus uses such information not for directing the graph of the casting cycle which is dependent on the height of the metal, but rather for its calculations in the case of castings without extra pressure using open molds.

Figure 2:
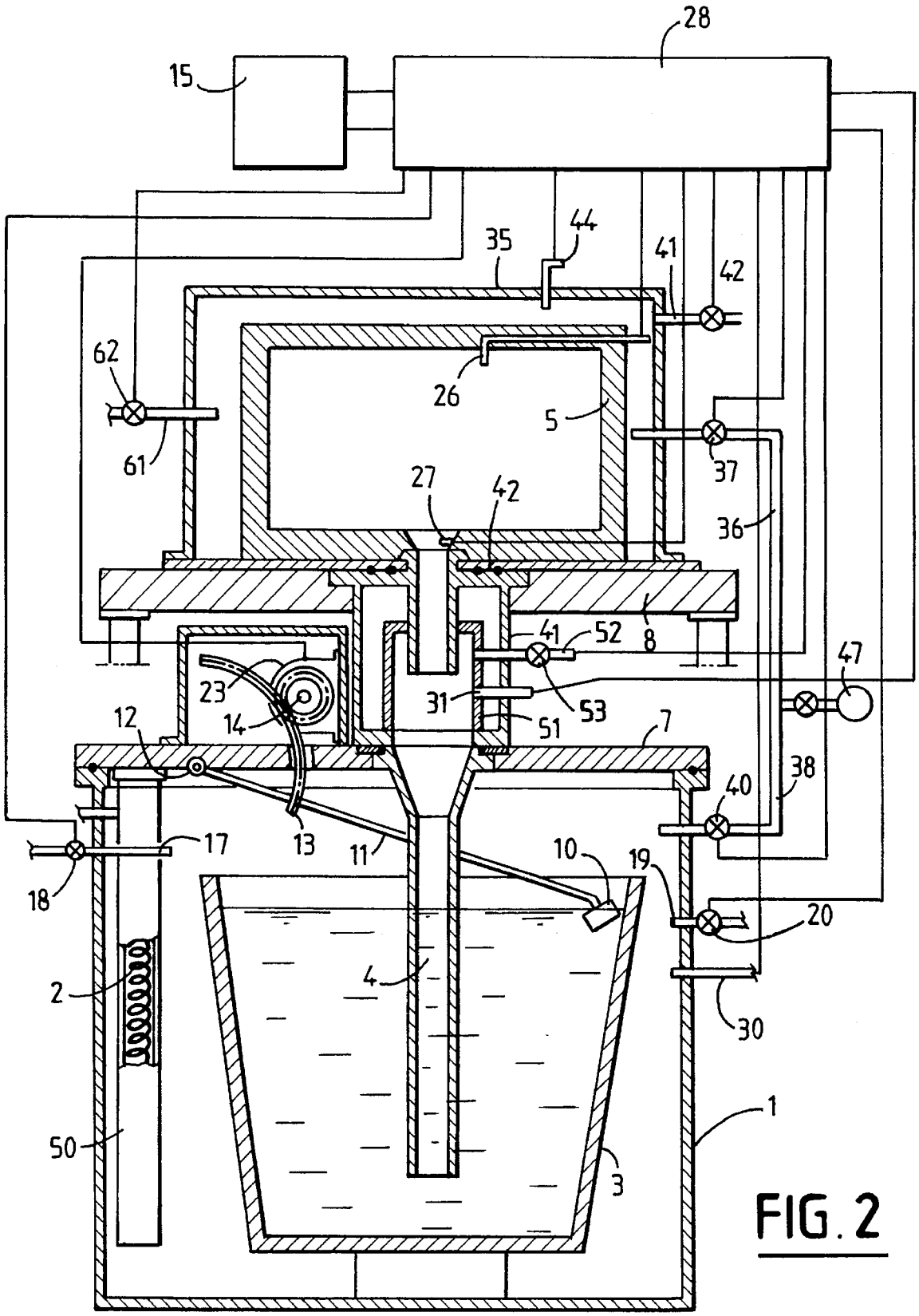
FIG. 2 is the corresponding diagram for magnesium alloys with vacuum and pressure.

According to a second embodiment illustrated in FIG. 2, the device for carrying out the method is applicable to magnesium alloys with possibility of placing the mold under vacuum and/or under special protecting atmosphere.

The device comprises the same means as illustrated for the embodiment of FIG. 1. The changes brought for magnesium are as follows:

The nozzle 41 connected to the tube 4 so as to form a one-piece assembly has a chamber 51 at the top of which is injected a protecting gas $CO_2$+$SF_6$ or Argon+$SF_6$ via the tube 52 equipped with an electrovalve 53. The injection occurs between two casting operations, it enables the protection of the metal of the tube 4 which is not covered by the protection of the crucible 3. Said injection on the nozzle is interrupted by the electrovalve at the start of the casting cycle.

The device comprises a tube 61 for injecting a protecting gas into the bell 35 equipped with an electrovalve 62. Said bell 35 which carries the mold 5 is a movable assembly. Before it reaches the casting station, the bell is placed under vacuum after which the protecting gas Argon+SF6 is introduced therein, and this bleeding cycle is repeated until a completely satisfactory protecting atmosphere is reached. The bell 35, which is kept under a slight extra pressure of Argon+SF6 gas is then brought over the casting station. These arrangements make it possible to cast the magnesium without oxygen.

The heating elements 2 are placed in tubes 50 of refractory steel so as to be isolated from corroding gases when these are at high temperature. Said tubes are thick enough not to deform under the effect of the vacuum or of the pressure in the furnace 1.

Aluminous insulating means and not siliceous materials, are provided between the furnace casing 1 and the heating elements to protect these against said gases.

Figure 3:
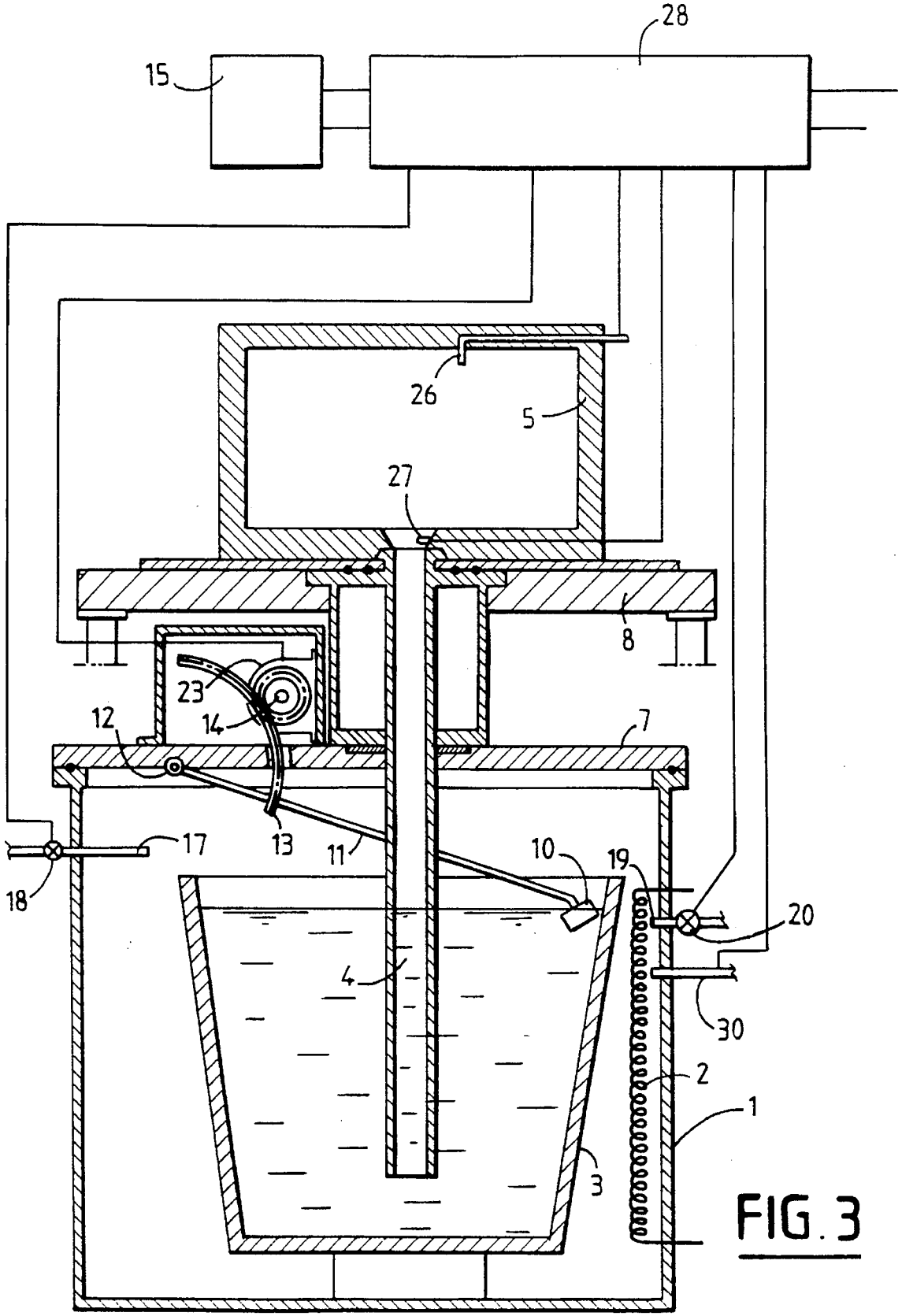
FIG. 3 is a diagram of an installation for carrying out the method wherein the mold is at atmospheric pressure, therefore no vacuum is used, but with pressure being applied on the metal.

According to a third embodiment of the device for carrying out said method, illustrated in FIG. 3, the mold is kept at the atmospheric pressure without any protecting gas, and there is no bell. All the other elements are the same as those shown in FIGS. 1 and 2. Said embodiment can also be applied to aluminum or to magnesium on condition that the above-mentioned special arrangements are provided.

The assembly according to the embodiment illustrated in FIG. 1 (with aluminum under vacuum and pressure) works as described hereinafter. In the case of magnesium (FIG. 2) the cycle is the same except for certain modifications which are indicated in the description.

The mold 5 can be equipped with presence sensors 31*a*, 31*b* similar to that shown at 31 in tube 4 (such as wires which are earthed when the metal flows over them), in order to effect the speed changes in the pressure curve of the furnace as a function of time if the casting operation is intended as a setting.

Figure 4:
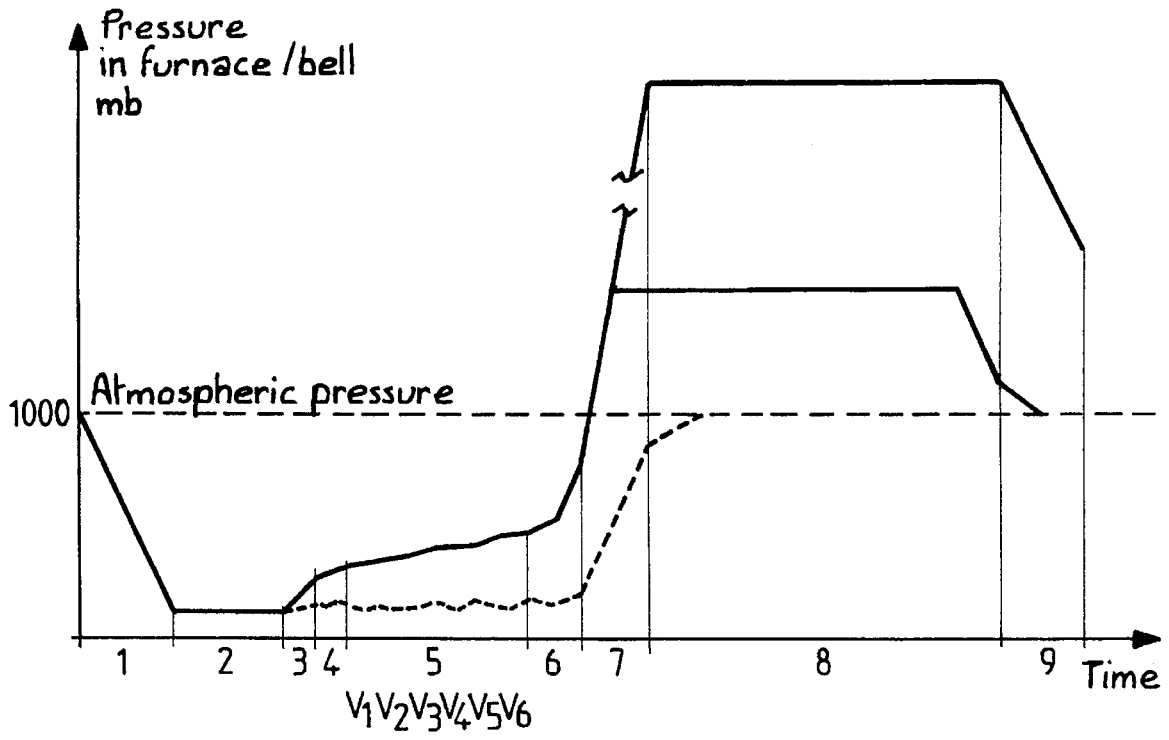
FIG. 4 shows a first curve of the pressure applied as a function of time.
Figure 5:
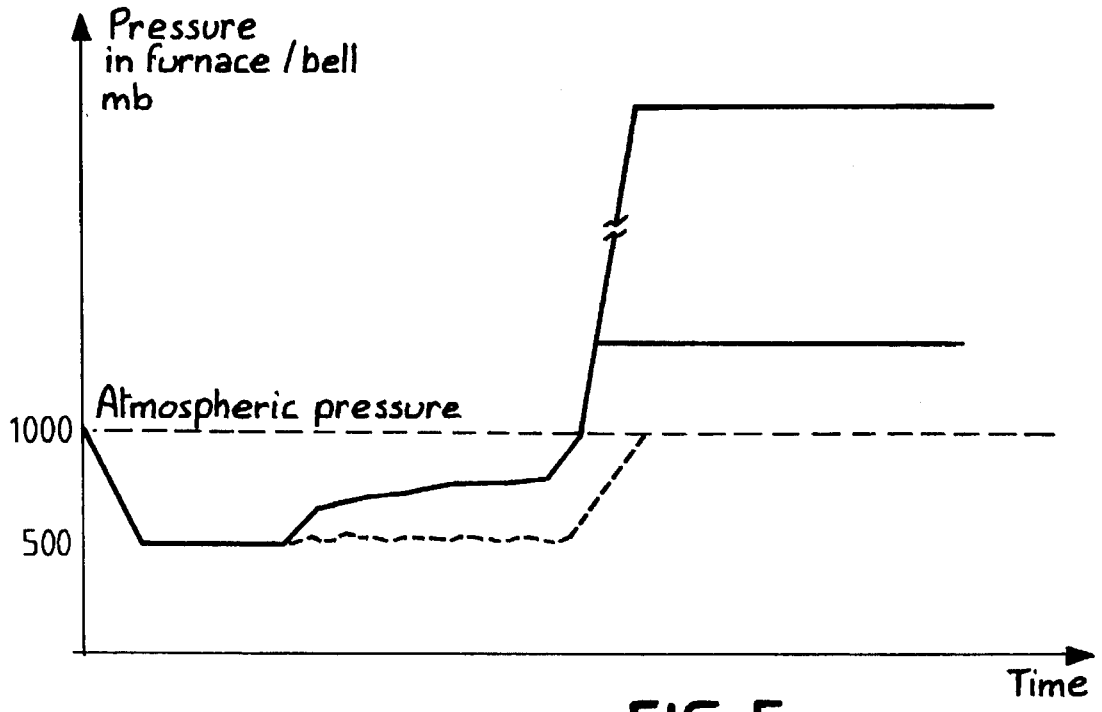
FIG. 5 shows a second curve of the pressure applied as a function of time.

The control apparatus 15 has received all the parameters retained (level of vacuum to be reached, speeds of pressure inside the furnace in various points of the curve causing different speeds for the metal, extra pressure values, keeping times, decompression speed, theoretical temperature of the metal at the opening of the mold, surface of the crucible, weight and height of the piece, etc. . . . ). Tables I and II give two examples of the parameters used in a casting under vacuum, respectively, of an aluminum alloy and of a magnesium alloy. The indications are displayed on the screen of the control apparatus 15 before casting. They can be altered according to the conventional intervention methods used with computers. The curve corresponding to Table I is illustrated in FIG. 4. That corresponding to Table II is illustrated in FIG. 5. The two enclosures, the metal one or furnace 1 and the mold one or bell 35 are at atmospheric pressure. The mold enclosure may be placed under a protecting atmosphere, as indicated hereinabove.

The safety module included in unit 28 associated with the control apparatus 15 checks that the conditions necessary for the machine to work correctly are met, notably:

that the mold 5 is locked in position on the plate 8, that the tightness between the tube 4 and the mold 5 is adequate, that the injection of gas into the tube 4 (if magnesium is used) is effected correctly, that the furnace is depressurized, etc. . . .

If all the safety conditions are met and if the temperature of the metal and that of the nozzle reach the theoretical values to within the tolerance limit, casting can begin.

The operator starts the vacuum pump 47 working; the electrovalves and 40 are opened by the control apparatus 15 and the two enclosures 1, 35 are placed under the required level of vacuum (areas 1 and 2 of the curve in FIG. 4). During this initial stage, which precedes the start of the injection of metal, the control apparatus checks that the detector for detecting the level of metal inside the crucible 3 works correctly, the gear 14 then raises up the sector 13 and resumes the starting position, and a check is made that the indication displayed by the movement sensor has gone back to the starting value, and further that the required level of vacuum is reached in the two enclosures. All these conditions having a tolerance value.

If all the aforesaid conditions are met, the control apparatus authorizes the start of the casting operation. When the operator initiates the injection (stage 2):

valve 40 for placing the furnace 1 under vacuum, closes, valve 18 for placing the furnace 1 under pressure, opens, valve 53 for injecting gas into the nozzle closes (if magnesium is used), valve 42 for connecting the bell 35 with the outside is closed.

During stage 3, the control apparatus creates inside the furnace an evolution of pressure in conformity with the parameters that it has received for filling the tube. The speed of the metal is quite fast (about 20 cm.sec. for said stage 3 of the curve in FIG. 4).

For stage 4, when the metal reaches the lower part of the nozzle, the control apparatus slows down its speed (3 cm/sec.) until it reaches the opening of the mold and flows over the temperature sensor 27 (said stage 4 of the curve begins at the inlet of the nozzle and ends after the metal has flowed over the temperature sensor 27). The flow of metal has been detected by the presence sensor 31 of the nozzle.

In stage 5, the metal penetrates into the mold 5 and the control apparatus 15 creates in the furnace 1 a pressure which takes into account the parameters received before the casting operation as well as the adjustments made by said apparatus as a result of:

the changing height of the metal in the crucible, and the temperature of the metal detected at the passage by the sensor 27.

Said adjustments can reach the same order of magnitude as the parameters to be observed; they are therefore necessary to set up, in every point of the mold, suitable predetermined conditions. During the filling stage 5, the speed changes, being controlled by the control apparatus as indicated from the difference of pressure inside the furnace 1 (sensor 30) and inside the mold 5 (sensor 26). The speed changes are determined from the presence sensors of the mold in the case of adjustment castings or by the stage durations if casting occurs in automatic conditions without any presence sensor.

Stage 6 corresponds to the end of the mold filling operation, the control apparatus applies an extra pressure on the metal according to predetermined speed and time parameters, in order to prevent the metal from penetrating between the sand particles (metal penetration) of the mold wall.

Stage 7 corresponds to the end of said extra pressure application which lasts about 6 seconds, then the mold enclosure 5 is returned quickly to the atmospheric pressure (within 2 to 3 seconds) by closing the vacuum valve 37 and opening the atmospheric pressure setting valve 42, and the furnace is very quickly brought to a higher pressure depending on the proposed application:

pressure less than 1 bar for conventional castings, or higher, reaching several tens of bars for special applications such as for pieces including elements in composite materials. The final pressure in the mold enclosure may be different from the atmospheric pressure.

In stage 8, when said pressures have been reached in the two enclosures, the control apparatus keeps up the obtained levels throughout the solidification of the piece. Control is effected by the pressure difference between the pressure in the furnace 1 (sensor 30) and the pressure inside the bell (sensor 44) since the sensor of the mold 26 has become inoperative due to the disappearance of atmosphere inside the mold.

In stage 9, at the end of solidification, given by the time indication of the parameters of the piece or by the indication of a metal temperature sensor, the furnace is depressurized. It is returned to the atmospheric pressure, according to a predetermined curve, by action of the control apparatus on the controlled valve 20 with a view to avoiding turbulences created by the metal flowing back into the crucible 3. This curve may result from a linear depressurization and take the form of a straight line corresponding to a depressurization speed $d_1$ or $d_2$. These speeds are proportionally linked to the speed of downward movement of metal in the tube, upon depressurization in the furnace and hence are given, in Tables I and II, in cm/sec.

It is also possible to control the cooling and solidification of the metal by injecting liquid nitrogen in predetermined points of the mold. The final pressure inside the furnace can differ from the atmospheric pressure, if the metal is required to stay at the upper part of the crucible. A number of special cases arise, as indicated hereinabove.

FIG. 5 corresponds to the cycle used with magnesium alloy, with a starting vacuum limited to a level which will prevent the release of magnesium fumes.

Figure 7:
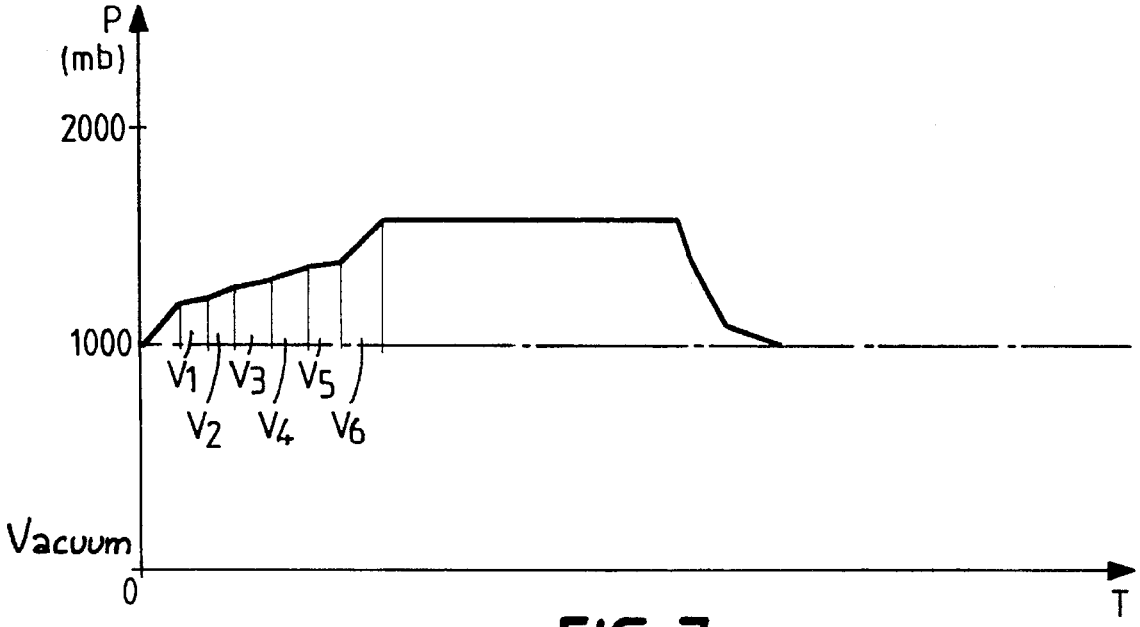
FIG. 7 shows a third curve of the pressure applied as a function of time.

FIG. 7 corresponds to the cycle used without vacuum on the metal and on the mold, namely low pressure casting. The method then provides the control of the casting curve to obtain the predetermined conditions and, in the case of magnesium, the mold is under the bell 35 of FIG. 2 in order to be kept under a special atmosphere.

Also in the case of magnesium, the heating elements have to be contained in tubes resistant to corrosion by $CO_2$—$SF_6$ and they are not under vacuum. As to the means for insulating the furnace, they contain materials which are not at risk of being corroded by $CO_2$—$SF_6$.

Figure 8:
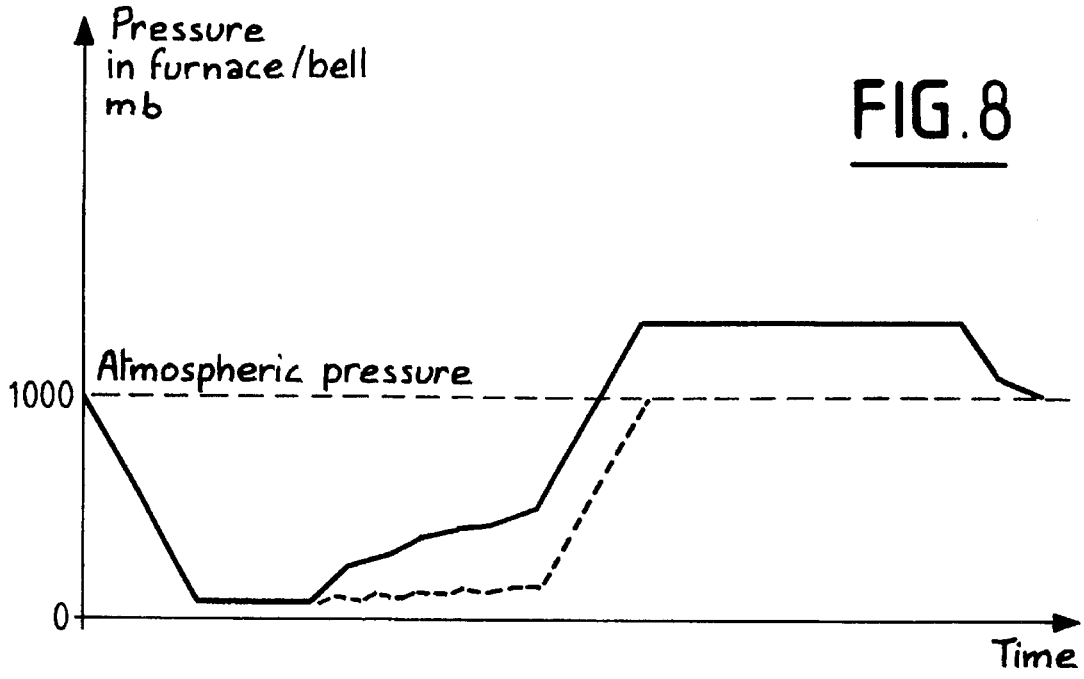
FIG. 8 shows a fourth curve of the pressure applied as a function of time.

FIG. 8 corresponds to the cycle of pressure with vacuum but without extra pressure on the metal once the mold has been filled. The bell is returned to the atmospheric pressure and the furnace is brought to a pressure higher than the atmospheric pressure by keeping up the difference of pressure $\Delta P$ existing when the mold is filled. It is possible, with this method, to cast a mold under vacuum with open feeder heads so that the lower part of the piece can solidify under pressure with feeding provided by the casting system, and so that the upper part can solidify at the atmospheric pressure with feeding provided through the open feeder heads at the upper part.

Figure 9:
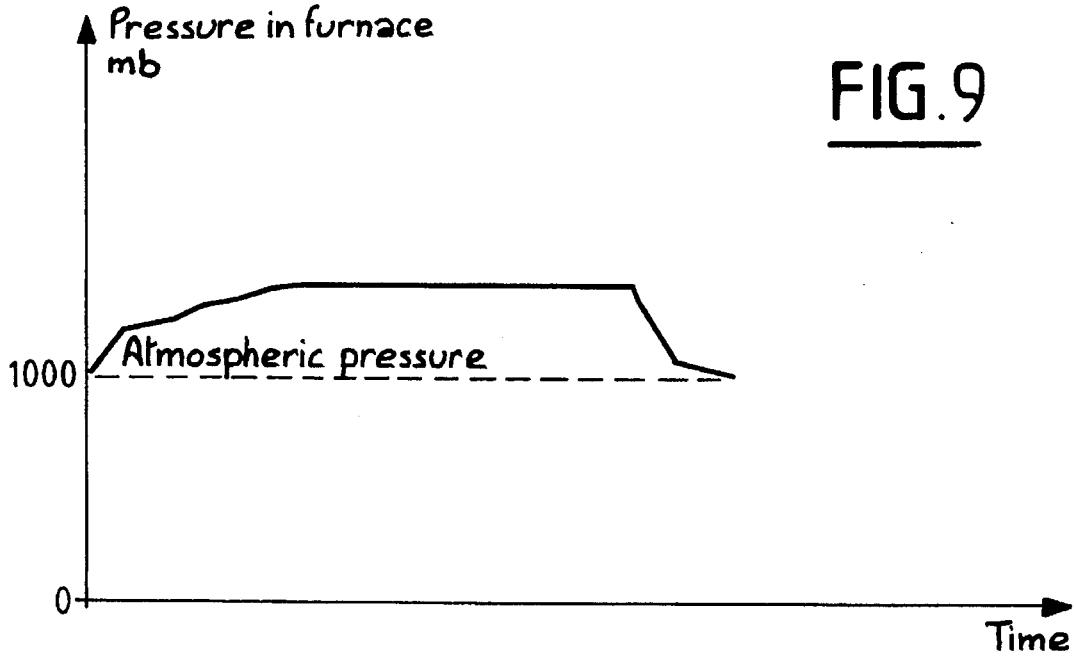
FIG. 9 shows a fifth curve of the pressure applied as a function of time.

FIG. 9 corresponds to a similar casting cycle but without vacuum.

Therefore, numerous cycles are herein disclosed, whose number is in no way restrictive and which only differ by the value of the parameters used by the control apparatus.

Said apparatus is constituted, in its simplest form, by a microcomputer using software which makes it possible to control these cycles from two independent elements of the parameters:

the quantity or height of metal inside the crucible at the start of and throughout the cycle, and the temperature of the metal at the opening of the mold.

Figure 6:
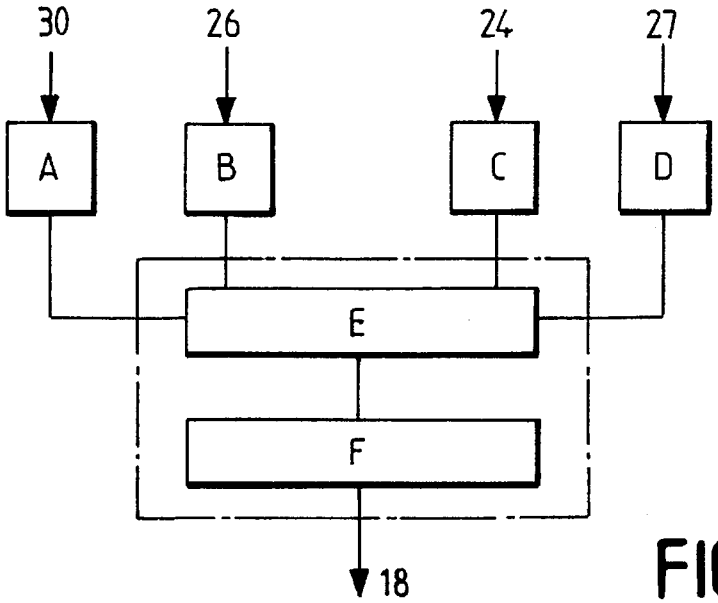
FIG. 6 is a block diagram of the method according to the invention.

The diagram shown in FIG. 6 illustrates the principle of the method according to the invention in the following different cases:

A: designates the pressure measured inside the furnace 1 by the sensor 30, B: designates the pressure measured inside the mold 5 by the sensor 26.

C: designates the level of the material in the crucible 3 measured during casting by the height measurement sensor 10–14.

D: designates the temperature of the alloy measured when it enters into the mold, by the sensor 27.

These various measurements are transmitted to a comparison stage E of the control apparatus 15 and compared with reference parameters determined beforehand and recorded in apparatus 15. This comparison is then used in an output determining stage F.

TABLE 1

| CRUCIBLE 1 | CASTING 1 | SAMPLE #1 | SPEED CM/SEC. | PRESSURE MB | TIME SEC. | SENSOR |
|---|---|---|---|---|---|---|
| DENSITY | 2.35 | RESID. VACUUM* | | 100.0 | 10.0 | |
| AL AS7G06 | | FILLING OF TUBE | 25.0 | | | |
| METAL TEMP. | 780° C. | | | | | |
| NOZZLE TEMP. | 780° C. | SPEED V1 | 3.0 | | 3.0 | 1 |
| VISCOSITY | 1.00 | V2 | 20.0 | | 3.0 | 0 |
| CRUCIBLE SURFACE | 7850 $cm^2$ | V3 | 3.0 | | 3.0 | 0 |
| NOZZLE SURFACE | 314 $cm^2$ | V4 | 0.0 | | 0.0 | 0 |
| | | V5 | 0.0 | | 0.0 | 0 |
| | | V6 | 0.0 | | 0.0 | 0 |
| | | End of filling speed | 0.0 | | | |
| PIECE WEIGHT | (not consid.) | EXTRA PRESSURE 1 | | 40.0 | 4.0 | |
| MOLD HEIGHT | (not consid.) | EXTRA PRESSURE 2 | | 80.0 | 2.0 | |
| | | Ret. of bell to atmos. press. | | 80.0 | 2.0 | |
| AMPLIT. DIAG.** | 2000 mb | SOLIDIFICATION TIME | | | | |
| | | depress. speed $d_1$ | 30.0 | | | |
| | | depress. speed $d_2$ | 10.0 | | | |
| CASTING METHOD: SETTING WITH VACUUM - WITH EXTRA PRESSURE | | | | | | |

*Residual vacuum is the pressure existing in the furnace at the end of a casting operation.
**Amplit. Diag. refers to the variation of the pressure levels in a given casting operation or cycle.

TABLE 2

| CRUCIBLE 1 | CASTING 1 | SAMPLE #2 | SPEED CM/SEC. | PRESSURE MB | TIME SEC. | SENSOR |
|---|---|---|---|---|---|---|
| DENSITY | 1.60 | RESID. VACUUM* | | 100.0 | 10.0 | |
| AL AS7G06 | | FILLING OF TUBE | 25.0 | | | |
| METAL TEMP. | 780° C. | | | | | |
| NOZZLE TEMP. | 780° C. | SPEED V1 | 3.0 | | 3.0 | 1 |
| VISCOSITY | 1.00 | V2 | 20.0 | | 2.0 | 0 |
| CRUCIBLE SURFACE | 7850 $cm^2$ | V3 | 3.0 | | 3.0 | 0 |
| NOZZLE SURFACE | 314 $cm^2$ | V4 | 20.0 | | 1.0 | 0 |
| | | V5 | 0.0 | | 0.0 | 0 |
| | | V6 | 0.0 | | 0.0 | 0 |
| | | End of filling speed | 0.0 | | | |
| PIECE WEIGHT | 10500 g | EXTRA PRESSURE 1 | | 40.0 | 4.0 | |
| MOLD HEIGHT | 200 cm | EXTRA PRESSURE 2 | | 80.0 | 2.0 | |
| | | Ret. of bell to atmos. press. | | 80.0 | 4.0 | |
| AMPLIT. DIAG.** | 2000 mb | SOLIDIFICATION TIME | | | 10.0 | |
| | | depress. speed $d_1$ | 30.0 | | 3.0 | |
| | | depress. speed $d_2$ | 10.0 | | | |
| CASTING METHOD: SETTING WITH VACUUM - WITH EXTRA PRESSURE | | | | | | |

*Residual vacuum is the pressure existing in the furnace at the end of a casting operation.
**Amplit. Diag. refers to the variation of the pressure levels in a given casting operation or cycle.

I claim:

1. A process for injection casting parts, particularly thin walled parts made of metallic alloys, polymers and alloy fiber composites, comprising:

placing inside a furnace a crucible containing a casting metal;

plunging an injection tube, arranged upon a plate covering the furnace, into the casting metal;

placing a mold on a support with the mold in fluid communication with the injection tube;

sealingly positioning a bell about the mold;

creating an equal vacuum level in both the mold and furnace without causing either the injection of the metal into the mold or the expulsion of the metal from the crucible;

filling the mold by pressurizing the furnace while maintaining pressure variations inside the furnace and the mold and speed variations of the metal inside the mold at any given instant at desired values based on a geometry of a part to be poured and a difference in height of the metal inside the crucible from the beginning of the filling of the mold to the given instant thereby causing a controlled injection of the metal into the mold while creating a pressure differential between the furnace and the bell;

bringing the bell to a pressure at least equal to atmospheric pressure while maintaining a difference in pressure between the furnace and the bell at least equal to said pressure differential;

maintaining the pressures in the furnace and the bell while the metal in the mold cools and solidifies; and depressurizing the furnace and the bell to atmospheric pressure.

2. The process as claimed in claim 1, further comprising: sensing the height of metal inside the crucible by sensing the quantity of metal inside the crucible.

3. The process as claimed in claim 1, further comprising: maintaining the speed variations of the metal inside the mold at desired values during filling of the mold in dependence upon a temperature difference between the metal when entering the mold and a reference temperature.

4. The process as claimed in claim 1, further comprising: applying on the metal, following filling of the mold, an overpressure which is greater than a pressure level present in the furnace during filling of the mold.

5. The process as claimed in claim 1, further comprising: injecting liquid nitrogen into the mold at predetermined points as the metal cools and solidifies.

6. The method as claimed in claim 5, further comprising:

sensing a temperature of the metal at an opening of the mold; and further governing the controlled rate and the pressure in the mold at the beginning and throughout the filling of the mold based on the sensed temperature.

7. A method of performing an injection casting operation comprising:

placing a crucible adapted to house a casting metal inside a furnace;

fluidly interconnecting the crucible with a mold;

sensing the height of metal inside the crucible;

simultaneously placing the mold and the furnace under an equal starting vacuum;

filling the mold at a controlled rate by pressurizing the furnace to cause the metal to flow from the crucible to the mold;

directly sensing a pressure inside the mold;

sensing the quantity of the metal in the crucible by sensing the height of metal inside the crucible;

governing the controlled rate and the pressure in the mold as a function of the sensed quantity of metal inside the crucible at the beginning of and throughout the filling of the mold;

maintaining the pressures in the mold and the furnace while the metal in the mold is cooled and solidified; and depressurizing the furnace to atmospheric pressure.

8. The method as claimed in claim 7, further comprising: placing the mold and the crucible in two separate enclosures and sealing said two separate enclosures.

9. The method as claimed in claim 7, further comprising: injecting liquid nitrogen into the mold at predetermined points as the metal is cooled and solidified therein.

10. An injection casting device comprising:

a sealed furnace;

a table;

a bell sealed to said table and fluidly isolated from said furnace;

a metal containing crucible located in said furnace;

a tube fixed to one of said table and said bell and extending into said crucible;

a mold located in said bell and open to said tube;

means for simultaneously creating a vacuum in said bell and said furnace, said creating means including:

at least one vacuum pump;

a first pipe interconnected between said at least one vacuum pump and said bell;

a second pipe interconnected between said at least one vacuum pump and said furnace;

a first valve arranged in said first pipe; and a second valve arranged in said second pipe;

pressure sensors for directly sensing a pressure in said mold and in said furnace respectively;

means for continuously determining the height of metal inside the crucible; and means for controlling, based on signals received from said pressure sensor and said determining means and through at least said first and second valves, the pressure inside said mold and said furnace in order to fill said mold with metal from said crucible and to regulate a metal flowing speed and pressure inside said mold during filling thereof.

11. The injection casting device as claimed in claim 10, further comprising temperature sensor means for sensing a temperature of a metal at an entrance to said mold and signalling said controlling means.

12. The injection casting device as claimed in claim 11, wherein said means for continuously determining the height of metal inside the crucible comprises a pivotable lever provided at one end with a float adapted to rest on an upper surface of the metal in said crucible and a sensor for determining a rotational angle of said pivotable lever, said sensor being interconnected with said controlling means.

13. The injection casting device as claimed in claim 10, further comprising:

a nozzle formed integral with said tube; and means for electrically heating and regulating the temperature of said nozzle.

14. The injection casting device as claimed in claim 13, further comprising a sensor for detecting the passage of metal in said tube, said sensor being defined by a tubular member including a chip which closes one end of the tubular member and to which is attached a thermocouple, said tubular member further including an air intake and an air outlet for supplying cooling air to said chip in order to maintain the chip at a predetermined temperature before a casting operation.

15. The injection casting device as claimed in claim 14, further comprising a valve arranged in the air intake.

16. The injection casting device as claimed in claim 10, further comprising:

a chamber surrounding a portion of said tube;

means for injecting a metal protecting gas within said chamber; and insulating O-rings provided at an upper part of said chamber, said O-rings being sealed against said table.

17. The injection casting device as claimed in claim 10, further comprising heating elements located in said furnace.

18. The injection casting device as claimed in claim 10, further comprising means for insulating the furnace, said furnace insulating means being formed of non-siliceous material.

19. The injection casting device as claimed in claim 10, further comprising:

a pressurized tank of gas;

a third pipe interconnected between said furnace and said pressurized tank of gas; and a third valve arranged in said third pipe.

20. The injection casting device as claimed in claim 19, wherein said first, second and third valves constitute proportional valves.

* * * * *